US005617585A

United States Patent [19]

Fons et al.

[11] Patent Number: 5,617,585

[45] Date of Patent: Apr. 8, 1997

[54] RUBBER SOLED SLIPPER SOCK

[76] Inventors: Roger D. Fons, 800 South St. Asaph, No. 203, Alexandria, Va. 22314; Raymond H. Crissman, 11923 Dormayne Dr., Hagerstown, Md. 21742

[21] Appl. No.: 668,625

[22] Filed: Jun. 19, 1996

Related U.S. Application Data

[63] Continuation-in-part of Ser. No. 502,254, Jul. 13, 1995.

[51] Int. Cl.[6] ..... A41B 11/00

[52] U.S. Cl. ..... 2/239; 36/9 R; 36/10

[58] Field of Search ..... 2/239, 409, 80, 2/83; 36/9 R, 102, 11, 10, 32 R, 12, 14

[56] References Cited

U.S. PATENT DOCUMENTS

| | | |
|---|---|---|
| 266,614 | 10/1882 | Douglass . |
| 387,035 | 7/1888 | Basch . |
| D. 347,518 | 6/1994 | Stewart . |
| 2,538,673 | 1/1951 | Donahue . |
| 3,383,782 | 5/1968 | McGinnity . |
| 4,276,671 | 7/1981 | Melton . |
| 4,294,022 | 10/1981 | Stockli et al. . |
| 4,317,292 | 3/1982 | Melton . |
| 4,651,354 | 3/1987 | Petrey . |

FOREIGN PATENT DOCUMENTS

| | | | |
|---|---|---|---|
| 5117902 | 5/1993 | Japan | 2/239 |

*Primary Examiner*—C. D. Crowder
*Assistant Examiner*—Gloria Hale
*Attorney, Agent, or Firm*—Terrance L. Siemens

[57] ABSTRACT

A slipper sock having a rubber sole liner. The lining is formed by embedding the sock within uncured, liquid latex rubber. The liquid rubber is prevented from embedding a central zone on the sole of the sock, but embeds fabric of the sock at the periphery of this zone. This is preferably accomplished by spraying a coagulant upon the sole of the sock, which causes immediate, localized curing of the uncured latex which then cannot permeate through the sock fabric. The liner thus is securely bonded to the sock. The sock has a sole comprising fabric unencumbered by rubber, thereby presenting a fabric material to the sole of a wearer's foot. The liner protects the fabric sole from abrasion and protects the wearer's foot from sharp objects and extreme temperatures, while the liner remains physically separate and apart from the fabric sole.

10 Claims, 2 Drawing Sheets

RUBBER SOLED SLIPPER SOCK

REFERENCE TO RELATED APPLICATION

This application is a Continuation-In-Part of Ser. No. 08/502,254, filed Jul. 13, 1995.

BACKGROUND OF THE INVENTION

1. FIELD OF THE INVENTION

The present invention relates to a rubber soled slipper sock and to a method of fabricating the same. The slipper sock comprises a fabric sock which is dipped into uncured latex or the like. The center of the sole of the slipper sock is coated with a coagulant which acts immediately upon contact with the uncured latex. The perimeter of the sole of the sock is not coated with coagulant, and becomes embedded in the latex. The uncoated central section of the sole rejects the latex, which cures immediately upon exposure to the coagulant. The result of this treatment is that a rubber sole is provided, which adheres by embedding at the periphery of the sole, but which remains apart from yet in contact with the fabric at the center. The fabric of the central portion is thus able to act as the sole of a fabric sock. Yet the rubber sole protects the sock, and is solidly secured thereto.

The slipper sock may be subsequently subjected to additional fabrication steps. Illustratively, indicia and tread texturing may be pressed into the sole prior to curing of the latex.

2. DESCRIPTION OF THE PRIOR ART

Footwear intended for use in a casual or recreational environment exists in many forms. Of course, socks of woven or knitted construction come to mind as the most casual of footwear when one has removed or is not wearing shoes. Such attire often conveys an unkempt or undressed appearance and certainly would be considered to be restricted solely to indoor use, such as in one's home. Conventional socks offer little or no protection against the elements or when the user ventures outside a building, even if one were to wear them merely to retrieve the morning paper or daily mail since they will instantly absorb even the morning dew. The most obvious objection is noted as one feels even the slightest irregularity in the surface of the ground or walkway since the smallest pebble etc. becomes readily apparent.

Numerous slipper socks of varying designs have been available for some time and these are primarily intended solely for wear about the home. Alternative slipper type footwear is known such as the all-rubber items provided for wear at the beach and for water aerobics. These latter items are akin to overshoes but comprise a totally impervious, quite tightly fitting, rubber device providing a slip resistant sole but which have been found to produce a binding effect upon the foot when worn for extensive periods of time. Also, in view of the impervious nature of the rubber composition, such footwear makes for a very hot foot when one is not constantly immersed in cool water.

Accordingly, a need will be seen for a slipper sock that is air pervious or of a composition that comprises a significant breathable portion, while having a waterproof, slip resistant sole portion. Preferably, the sole portion of the slipper sock presents a breathable portion to the sole of the wearer's foot. Additionally, the ideal slipper sock should have a reinforced heel portion serving to provide for ease of application and removal from the foot, with such reinforcement providing both an enhanced non-slip grasping area while strengthening the otherwise knitted or pervious rear area of the footwear upper portion.

Exemplary of known slipper socks is that as shown in U.S. Pat. No. 4,276,671, issued to Florence Melton on Jul. 7, 1981, and which illustrates a construction method wherein a stretchable sock is provided with a disparate sole member, with or without an intermediate cushion element. Additionally, no reinforcing coating is seen in the heel area of Melton, as proposed in the present invention. It will be further noted that Melton employs a bonding step, employing either stitching or liquid adhesives, to secure a pre-existing sole to the sock. By contrast, the sole and bonding therefor are provided in a single step of dipping the sock into liquid latex rubber. The sock is thus embedded in the material of the sole, unlike the construction of Melton.

U.S. Pat. No. 4,317,292, issued Mar. 2, 1982, to Florence Melton is a division of the above described earlier patent and is directed to the slipper sock article per se. The same comments and distinctions as related hereinabove regarding the prior patent are repeated here by reference thereto.

Dipping a sock into a rubber composition for coating is shown in U.S. Pat. No. 266,614, issued to Elizabeth N. Douglass on Oct. 31, 1882. However, both the method and the product lack an important feature of the present invention, that being that the rubber liner embeds the sock at the periphery of the sole, but partially escapes impregnation at the sole area. The user places his or her foot on rubber in the Douglass device, but on the fabric of the sock in the present invention.

A construction seen in U.S. Pat. No. 3,383,782, issued to James R. McGinnity on May 21, 1968, enables a fabric sole of a slipper sock to remain exposed to the sole of the wearer's foot. However, the fabric is bonded to a synthetic resin sole continuously and coextensively, unlike the present invention. In the present invention, fabric is embedded within uncured material at the periphery of the sole and part way up the lateral walls of the sock, and projects above the finished resin sole or liner. Also, McGinnity's outsole or liner is perforated, unlike that of the present invention.

Another slipper sock is shown in U.S. Pat. No. Des. D-347,518 issued on Jan. 7, 1994, to Theresa Stewart and which illustrates an apparent flexible upper portion having a sole portion affixed thereto, the latter presenting grooves or the like. The rear of this sole portion extends upwardly a short distance to overlie the base only of a wearer's heel. Although the Stewart sole portion covers the extent of the foot sole and projects upwardly about the periphery thereof, the slightly elevated heel portion of this sole covering does not extend upwardly to a point juxtaposed the ankle opening and thus would offer little area for grasping by a user attempting to don or remove the slipper sock and a user would tend to grasp the soft upper portion of the sock during such maneuvers, thereby encouraging tearing or strain in this critical area of the sock. The patent to Stewart certainly fails to teach embedding of the fabric sock in a latex sole.

None of the above inventions or patents, taken either singly or in any combination, is seen to even remotely suggest or describe the instant invention as claimed herein.

SUMMARY OF THE INVENTION

The slipper sock of this invention provides a unitary shell comprising a pervious or foraminous composition preferably formed of knitted or woven material offering a stretch fabric presenting a soft, comfortable shell enveloping a user's foot. This shell is adapted to fully envelop one's foot and includes a lower sole portion integral with an upper portion providing a rear top section enveloping the ankle. A rubber or soft plastics composition impregnates the sole portion at its periphery, adjacent the upper portion, to provide an impervious coating on at least the exterior of the shell sole portion to provide a slip resistant, waterproof and comfort layer throughout that area of the slipper sock destined to engage various types of surfaces such as the earth, sand, pavement or the like.

The center of the sole is partially free of impregnation, thereby presenting the same benefits to the wearer's sole that would accrue from wearing a plain sock unencumbered by a rubber liner. Yet the protective liner is present beneath the sock to provide protection against sharp objects, temperature, penetration by moisture, and the like.

To facilitate the donning and removal of the slipper sock, the rear area of the upper portion of the shell is additionally impregnated with the same rubber-like composition that may extend to coat both the exterior and interior of the heel area of the shell. In this manner, a more positive grasping of the heel area between two fingers may be accomplished to pull on and remove the slipper sock while this latter coating further enhances the retention of the slipper sock upon the heel of the wearer, without detracting from the breathability of the majority of the stretchable shell upper portion that overlies a significant area of the user's foot.

Accordingly, one of the objects of the present invention is to provide an improved slipper sock including a unitary shell of stretchable knitted or woven fabric having sole and upper portions, and a rubber lining at the sole portion.

Another object of the present invention is to provide an improved slipper sock including a shell of stretchable, pervious fabric having an impervious coating on at least the exterior of the sole portion thereof and which coating extends to impregnate the rear area juxtaposed the heel of the shell.

Still another object of the present invention is to provide an improved slipper sock including a shell of resilient, pervious composition having a single elevated ankle-engaging portion adjacent a heel area and with a rubber-like coating impregnating the sole of the shell and covering the exterior and interior of the heel area, while the majority of the top of the shell and a sole portion present a breathable, porous area.

It is a further object of the invention to secure the liner to the sock by embedding the latter within the former.

Still another object of the invention is to provide the benefits of a fabric sole partially unencumbered by impregnation by or embedding within a rubber liner.

It is again an object of the invention to form a rubber lining and to bond this lining to a sock in a single step.

It is still a further object of the invention to eliminate separate bonding steps and materials, as seen in Melton.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
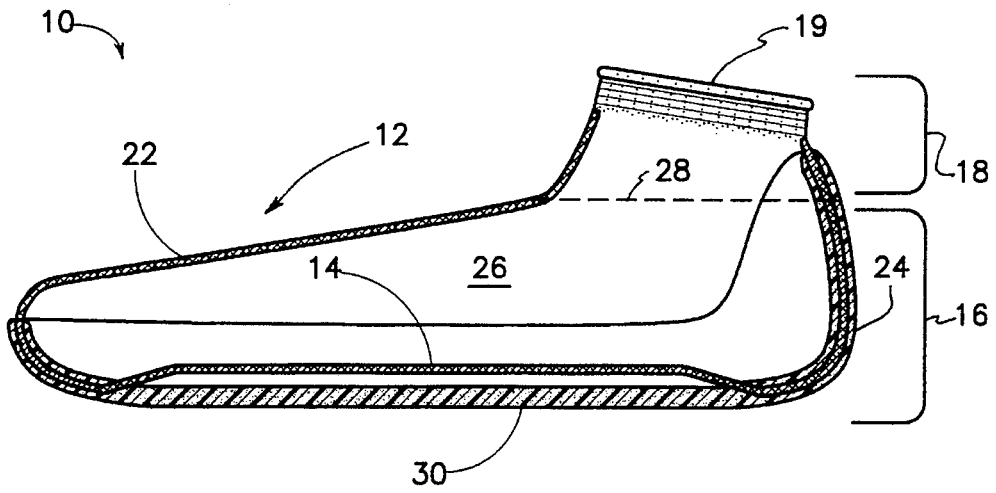
FIG. 1 is an exaggerated side elevational, mostly cross sectional view of the invention.

Turning now to FIG. 1 of the drawings, the novel slipper sock 10 is seen to comprise a shell 12 fabricated from an interlaced fabric, such as woven or knitted cotton, wool, nylon, rayon, or any other fabric. Preferably, the fabric is a stretchable, elastic fabric. Shell 12 is preferably a preformed sock or other preexisting fabric apparel for a wearer's foot (not shown). A sock has the advantage of being readily procured, and providing an enclosed body comprising a sole portion 14, an adjacent upper body portion 16, and a sleeve 18. Sleeve 18 preferably includes an elastic rim 19 having a diameter less than that of sleeve 18. Elastic rim 19 gathers sleeve 18 against the ankle or leg of the wearer, thereby preventing drafts from entering the interior 26 of slipper sock 10.

Upper body portion 16 may be regarded as being further comprising a sole periphery 20 located at the outer bounds of sole portion 14 and generally demarcating a transition between the normally horizontal sole and lateral walls of upper body portion 16 of the sock. Upper body portion 16 has an upper panel 22 which covers the top of the wearer's foot, and a heel portion 24 covering the wearer's heel. Sleeve 18 is open at the top for providing access for the foot of a wearer into the interior 26 of slipper sock 10. Sleeve 18 is attached to upper body portion 16 proximate heel portion 24 in conventional manner.

These divisions of an ordinary sock are arbitrary, and are set forth only to clarify the nature of the invention. It will be appreciated that a sock is of generally continuous construction, and that arbitrary areas, zones, or components of the sock as described above lack clearly defined boundaries. For clarity then, a division line 28 dividing upper body portion 16 from sleeve 18 is shown in a purely representative capacity.

Thus far, components of the novel slipper sock 10 include only components of a conventional sock, arbitrarily labeled to facilitate description of cooperation with a rubberized liner 30. Liner 30 is a flexible member bonded to shell 12 by embedding shell 12 within liner 30. As seen in FIG. 1, upper body portion 16 projects upwardly and away from liner 30 at sole periphery 20. Also, sole portion 14 projects upwardly and away from liner 30, thereby enabling the sole of a wearer's foot to rest on a fabric portion of shell 12. As depicted in FIG. 1, separation of sole portion 14 from liner 30 is exaggerated for emphasis. In practice, the fabric of sole portion may be partially embedded in liner 30 in that lower fibers of the fabric may be embedded, while upper fibers are not contacted by the constituent material of liner 30. This partial embedding is acceptable, since the wearer's foot will be exposed to fabric and not directly exposed to the consituent material of liner 30.

Although sole portion 14 is shown substantially spaced apart from liner 30, donning of slipper sock 10 will result from time to time in sole portion 14 being pressed against liner 30, since both the fabric of shell 12 and liner 30 are flexible. The actual relationship of sole portion 14 to liner 30 is one of partial embedding of sole portion 14 within liner 30. A significant portion of fabric of sole portion 14 is exposed to the user's foot, the upper surface of sole portion 14 being free of constituent material of liner 30. Of course, since both sole portion 14 and liner 30 are flexible, it is also possible that parts of sole portion 14 and liner 30 abut, and other parts remain spaced apart. It is therefore more accurate to describe sole portion 14 as being unencumbered from embedding within liner 30.

Figure 2:
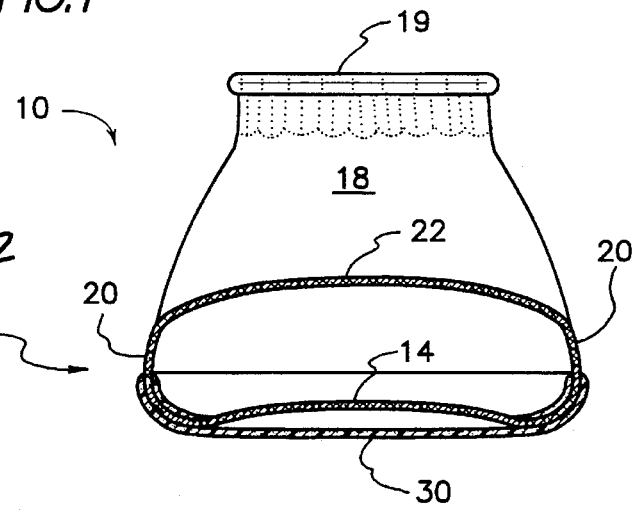
FIG. 2 is an exaggerated front elevational, mostly cross sectional view of the invention.

FIG. 2 shows the subject matter of FIG. 1, but from a different angle. FIG. 2 emphasizes that a broad expanse of sole portion 14, preferably of sufficient magnitude to cover the entire sole of the wearer's foot, is free from embedding in liner 30.

Figure 3:
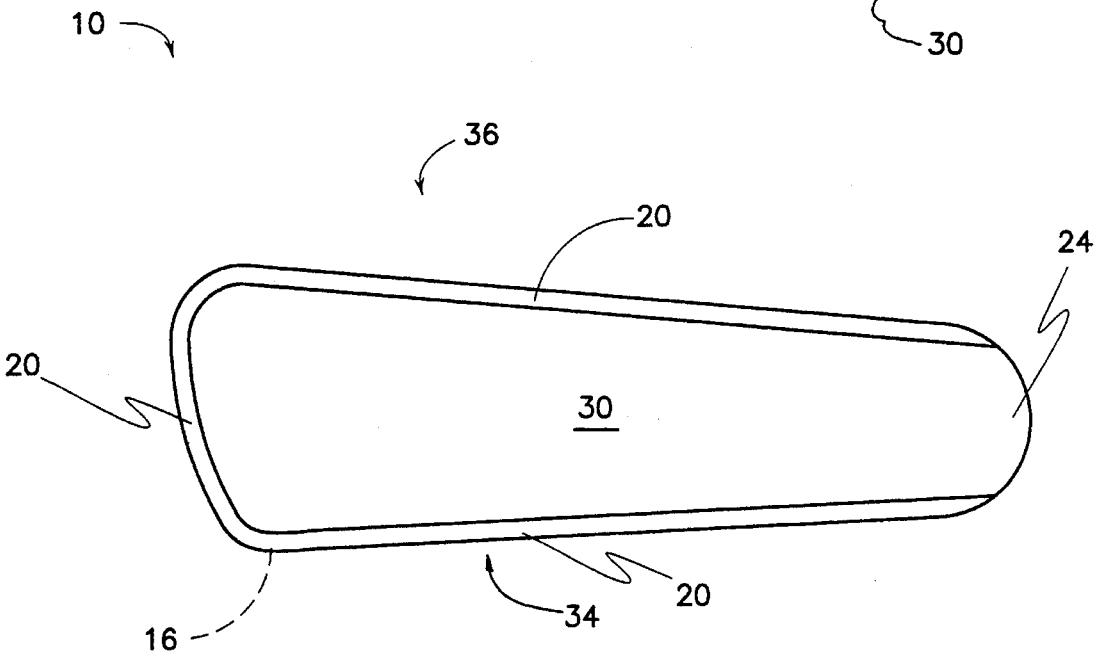
FIG. 3 is a bottom plan view of the invention.

A further clarifying view is presented in FIG. 3. FIG. 3 illustrates slipper sock 10 in bottom plan view. It will be noted that while liner 30 terminates at right and left lateral sides 34, 36 and at the toe 38 of upper body portion 16, it does not so terminate at heel portion 24. Rather, liner 30 continues vertically upwardly, following the form of heel portion 24, as also shown in FIG. 1.

Figure 4:
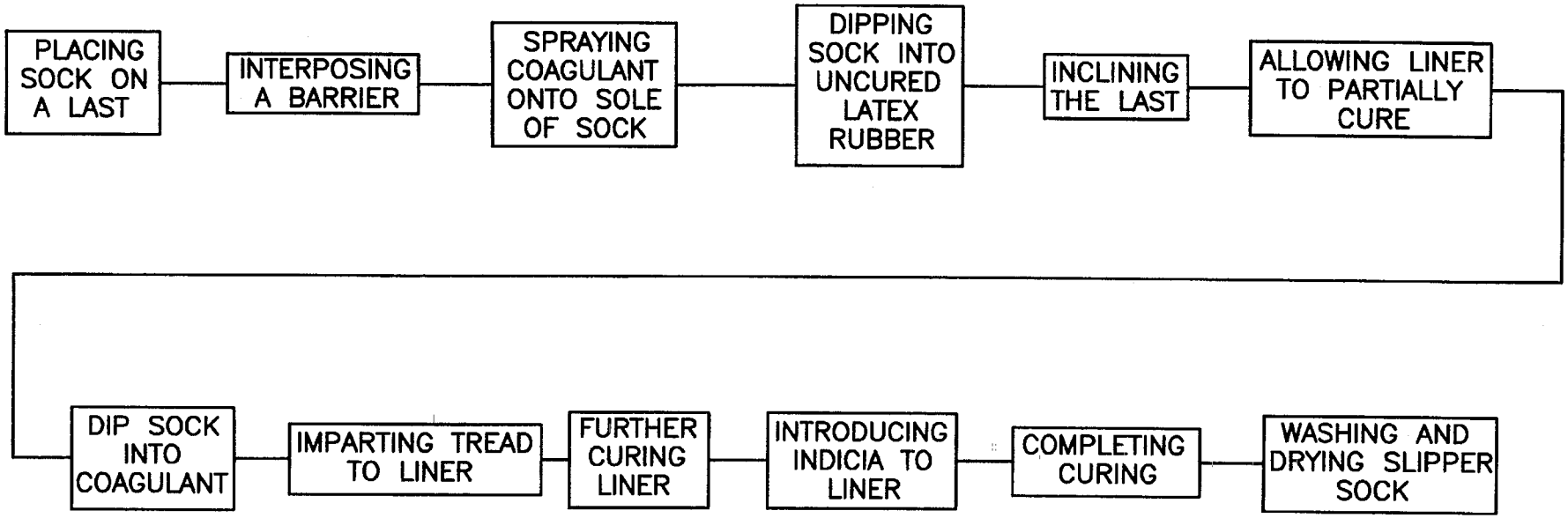
FIG. 4 is a block diagram summarizing the steps of a method of producing the invention, and is read from left to right.

The novel process for fabricating the above construction will now be described. The principal steps of the method are summarized in the block diagram of FIG. 4, with reference numerals referring to elements illustrated in FIGS. 1–3. First, an untreated fabric sock or shell 12 is placed on a foot form (not shown), such as a last. Next, a predetermined zone or central portion of sole portion 14 of shell 12 is protected from contact with liquid latex. The predetermined zone is that portion of sole portion 14 corresponding to that ordinarily contacting the sole of a wearer's foot when the slipper sock is donned.

Protection of the predetermined zone from contact with and subsequent impregnation by latex is accomplished by interposing a barrier between the fabric and the liquid latex. The barrier may take any of several forms. One method of providing a barrier is to spray a coagulant onto that portion of sole portion 14 of shell 12 which is to be left free of latex. Sole portion 14 is saturated with coagulant.

Next, shell 12 and last are dipped into uncured latex to a depth such that sole portion 14 is fully submerged, and upper panel 22 of upper body portion 16 is unexposed to the uncured latex. Latex flows around the fabric of shell 12, thereby embedding the fabric in liquid latex.

However, coagulant which has saturated sole portion 14 of shell 12 causes instantaneous curing of the upper surface of the liquid latex, thereby forming a skin which resists penetration of the fabric by the latex. A patch of fabric thus remains apart from the latex despite further immersion of the last and shell 12. A coagulant which has proved effective in this capacity is product number ND-46, which is commercially available from Upaco Adhesives, 3 East Spit Brook Road, Nashua, N.H. 03060. A suitable latex rubber product is commercially available as Vultex (a registered trademark of General Latex and Chemical Co., P.O. Box 498, Ashland, Ohio, 44805), Number 1R-729.

The last is inclined, thereby subjecting heel portion 24 of shell 12 to immersion in liquid latex to a point well above upper panel 22 of upper body portion 16 of shell 12, when slipper sock 10 is restored to a horizontal orientation. Thus, both sole portion 14 of the finished slipper sock 10 and heel portion 24 will be provided with a rubber reinforcing liner 30, although the predetermined patch of sole portion 14 treated with coagulant will not be totally impregnated with rubber. Rather, a rubber stratum will be formed just below this predetermined zone.

Shell 12 and uncured rubber liner 30 are allowed to stand, thereby partially curing or drying. During this period, after liner 30 has cured sufficiently to develop a somewhat dry external skin, tread is imparted to sole section 14 by pressing shell 12 and the last against a mold (not shown). After forming tread, liner 30 is further cured, preferably by active measures, such as subjecting liner 30 to heat, forced flow of air, or both.

Prior to final curing, indicia may be introduced into liner 30. This indicia may identify the size of slipper sock 10 by a number corresponding to a standard industry size, or may indicate a brand name or patent number under which fabrication has been licensed. Once again, pressing will impart permanently formed indicia if performed prior to final curing.

When no further features must be impressed upon liner 30, curing or drying is completed. Preferably, this process is expedited by adopting active measures.

Slipper sock 10 may then be removed from the last. Prior to utilizing slipper sock 10 or packaging it for retail distribution, it is washed to remove any impurities remaining from fabrication processes, and dried.

Thus it is seen that a slipper sock is provided which affords the usual advantages of a rubber sole, while also presenting a fabric sole to the wearer's foot. This improves grip of the foot with respect to the slipper sock and also improves comfort. Yet the sock is securely bonded to the rubber liner.

In an alternative construction (not shown), an intersole may be provided inside the sock. In this case, latex rubber is allowed to permeate the sole portion of the sock and to extend to the intersole. The latex rubber will partially permeate the intersole, thereby bonding the intersole and sock to the liner. Steps may be taken to limit penetration of latex rubber through the intersole, so that a porous, resilient cushion is presented for direct contact with the sole of the wearer's foot.

It will be appreciated that the present invention may be practiced in many ways. For example, while the invention has been described in terms of employing latex rubber as a constituent material for the liner, it would be feasible to utilize any material which may be applied in fluid form and which dries or cures to a flexible solid material having requisite strength and other properties. Examples may be found among commercially available synthetic resins or any substances having similar properties relative to fabrication and to performance of the finished product.

Forming a skin or cured surface of a body of latex rubber or an equivalent may be performed by causing the fluent body to cure at a predetermined area corresponding to the predetermined zone of the sole of the sock in any suitable manner. Application of catalytic substances, energy, or any other agent would be acceptable if the area so treated could be suitably controlled as to its location. Also, interposing a preformed, separate, solid barrier below the sole portion of the fabric of the sock and uncured latex rubber would offer a further alternative. As an example, a patch of flexible sheet material impervious to latex rubber would be suitable.

It is to be understood that the present invention is not limited to the embodiments described above, but encompasses any and all embodiments within the scope of the following claims.

I claim:

1. A slipper sock comprising:

a shell fabricated from an interlaced fabric and including an enclosed body having a sole portion, a sole periphery located at the outer bounds of said sole portion, an adjacent upper body portion having an upper panel, a heel portion, and a sleeve open at the top for providing access for the foot of a wearer into the interior of said slipper sock, said sleeve being attached to said upper body portion proximate said heel portion;

a flexible liner bonded to said shell by embedding said shell within said flexible liner, said upper body portion projecting from said flexible liner and being embedded within said flexible liner, and said sole portion projecting above and from said flexible liner and being partially unencumbered by embedding within said flexible liner, whereby the sole of a wearer's foot may rest on a fabric portion of said shell.

2. The slipper sock according to claim 1, said fabric being a stretchable fabric.

3. The slipper sock according to claim 1, said sleeve of said shell including an elastic rim having a diameter less than that of said sleeve.

4. A method for producing a sock having a rubber liner at the sole and heel, the fabric of the sock being embedded within the rubber liner at the periphery of the sole and heel but being partially free from embedding at a central area of the sole and heel, said method comprising the steps of:

a) providing a fabric sock;

b) providing a barrier to liquid latex rubber at a predetermined zone on the sock, the predetermined zone corresponding to an area which bears the weight of a wearer when the user is wearing a sock and standing;

c) immersing the sock in liquid latex rubber to a point above the sole of the sock and below an upper panel of the body of the sock; and d) causing the latex to cure.

5. The method according to claim 4, further comprising a step of e) supporting the fabric sock on a form prior to immersing the sock in liquid latex rubber.

6. The method according to claim 4, further comprising a step of f) inclining the sock and subjecting the heel of the sock to immersion in liquid latex to a point well above the upper panel of the body of the sock.

7. The method according to claim 4, further comprising the step of g) forming a tread in the sole of the rubber liner by pressing the rubber liner against a mold prior to allowing the rubber liner to fully cure.

8. The method according to claim 4, further comprising the step of h) pressing indicia into the rubber liner prior to allowing the rubber liner to fully cure.

9. The method according to claim 4, said step of providing a barrier further comprising a step j) of spraying a coagulant onto the sock at the predetermined zone of the sole of the sock, thereby causing liquid latex rubber to form a skin resisting total embedding of the sock within latex rubber at the predetermined zone of the sole of the sock.

10. A slipper sock fabricated by the process of producing a sock having a rubber liner at the sole and heel, the fabric of the sock being embedded within the rubber liner at the periphery of the sole and heel but being partially free from embedding at a central area of the sole and heel, said process comprising the steps of:

a) providing a fabric sock;

b) providing a barrier to liquid latex rubber at a predetermined zone on the sock, the predetermined zone corresponding to an area which bears the weight of a wearer when the user is wearing a sock and standing;

c) immersing the sock in liquid latex rubber to a point above the sole of the sock and below the upper panel of the body of the sock; and d) causing the latex to cure.

* * * * *